US011761149B2

(12) United States Patent
Meguro

(10) Patent No.: US 11,761,149 B2
(45) Date of Patent: Sep. 19, 2023

(54) NAPPED ARTIFICIAL LEATHER

(71) Applicant: KURARAY CO., LTD., Kurashiki (JP)

(72) Inventor: Masashi Meguro, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 162 days.

(21) Appl. No.: 16/610,535

(22) PCT Filed: Jun. 6, 2018

(86) PCT No.: PCT/JP2018/021748
§ 371 (c)(1),
(2) Date: Nov. 4, 2019

(87) PCT Pub. No.: WO2018/230417
PCT Pub. Date: Dec. 20, 2018

(65) Prior Publication Data

US 2020/0071879 A1 Mar. 5, 2020

(30) Foreign Application Priority Data

Jun. 14, 2017 (JP) ..... 2017-117179

(51) Int. Cl.
*D06N 3/00* (2006.01)
*D06N 3/14* (2006.01)

(52) U.S. Cl.
CPC ..... *D06N 3/0075* (2013.01); *D06N 3/0004* (2013.01); *D06N 3/004* (2013.01);
(Continued)

(58) Field of Classification Search
CPC ..... D06N 3/145; D06N 3/004; D06N 3/0011; D06N 3/14; D06N 3/0075; D06N 2211/28;
(Continued)

(56) References Cited

U.S. PATENT DOCUMENTS 5,416,958 A * 5/1995 Lilly ..... D01F 6/62 26/29 R
2002/0098756 A1* 7/2002 Sasaki ..... D06N 3/0004 442/77

(Continued)

FOREIGN PATENT DOCUMENTS

CN 1957137 A 5/2007
JP 2003-268680 A 9/2003

(Continued)

OTHER PUBLICATIONS

"Toughness." Complete Textile Glossary. New York, NY: Celanese Acetate, 2001. N. pag. Print. (Year: 2001).*

(Continued)

*Primary Examiner* — Larissa Rowe Emrich
(74) *Attorney, Agent, or Firm* — Oblon, McClelland, Maier & Neustadt, L.L.P.

(57) ABSTRACT

A napped artificial leather including a non-woven fabric including ultrafine fibers and a polyurethane, the napped artificial leather including a napped surface formed by napping the ultrafine fibers on a surface thereof, wherein the napped surface has, after a Martindale abrasion test in accordance with JIS L 1096 (6.17.5E method, Martindale method) under a pressing load of 12 kPa and 50000 times of abrasions, a ratio of the polyurethane observed by a surface observation using an electron microscope in a portion that has been subjected to the Martindale abrasion test, of 4.0% or less.

7 Claims, 2 Drawing Sheets

(52) U.S. Cl.
CPC ..... *D06N 3/0011* (2013.01); *D06N 3/14* (2013.01); *D06N 3/145* (2013.01); *D06N 2209/0823* (2013.01); *D06N 2209/105* (2013.01); *D06N 2211/28* (2013.01)

(58) Field of Classification Search
CPC ..... D06N 3/0004; D06N 2209/0823; D06N 2209/105; D06N 2209/1685
See application file for complete search history.

(56) References Cited

U.S. PATENT DOCUMENTS

| | | | | |
|---|---|---|---|---|
| 2002/0114919 | A1* | 8/2002 | Yoneda | D06N 3/128 428/91 |
| 2008/0102245 | A1 | 5/2008 | Mimura et al. | |
| 2011/0039055 | A1 | 2/2011 | Fujisawa et al. | |
| 2011/0070422 | A1* | 3/2011 | Ammirati | D06N 3/147 428/297.4 |
| 2016/0215444 | A1* | 7/2016 | Ashida | D06N 3/145 |
| 2018/0230645 | A1 | 8/2018 | Hirose et al. | |

FOREIGN PATENT DOCUMENTS

| | | | | |
|---|---|---|---|---|
| JP | 2006-45723 | A | 2/2006 | |
| JP | 2006-89863 | A | 4/2006 | |
| JP | 2007-262616 | A | 10/2007 | |
| JP | 2011-74541 | A | 4/2011 | |
| JP | WO 2015/045367 | A1 | 4/2015 | |
| JP | WO 2017/022387 | A1 | 2/2017 | |
| WO | WO 2009/157063 | A1 | 12/2009 | |
| WO | WO-2015045367 | A1 * | 4/2015 | D06N 3/0011 |

OTHER PUBLICATIONS

International Search Report dated Aug. 21, 2018 in PCT/JP2018/021748 filed on Jun. 6, 2018.

* cited by examiner

NAPPED ARTIFICIAL LEATHER

FIELD

The present invention relates to a napped artificial leather that has excellent resistance to whitening caused by friction or abrasion, and that can be preferably used as a surface material for clothing, shoes, articles of furniture, car seats, general merchandise, or the like.

BACKGROUND ART

Conventionally, napped artificial leathers such as a suede-like artificial leather and a nubuck-like artificial leather are known. Napped artificial leathers have a napped surface formed by raising the fibers on the surface layer by napping the surface of a fiber base material including a non-woven fabric impregnated with an elastic polymer.

In a napped artificial leather, the napped surface may sometimes undergo whitening. Such whitening may cause impairment of the appearance of a product obtained by using the napped artificial leather, and thus is not preferable.

As for the whitening phenomenon of the napped surface of a napped artificial leather, for example, PTL 1 listed below describes that, as a result of elaborate analysis of the progression of whitening in an artificial leather using an electron microscope, the following mechanism has been found: The major cause of the whitening lies in fibrillation of ultrafine fibers, and an increased surface area due to the fibrillation results in an increase of irregular reflection on the surface, thus further promoting the whitening. Then, PTL 1 discloses a suede-like artificial leather, which is said to be found based on the aforementioned finding, for which improvement has been made in terms of the whitening phenomenon. Specifically, PTL 1 discloses a suede-like artificial leather that includes a surface layer formed at least by ultrafine mono filaments, and that has been impregnated with an aqueous polyurethane and dyed, wherein the suede-like artificial leather is capable of withstanding 30000 times or more of Martindale abrasion, has a lightness difference before and after 10000 times of Martindale abrasion, of 5.0 or less, and has a difference between a lightness difference before and after 30000 times of Martindale abrasion and a lightness difference before and after 10000 times of Martindale abrasion, of 6.0 or less.

PTL 2 listed below discloses a method for producing a nubuck-like artificial leather that provides dense fluff and fine creases. Specifically, PTL 2 discloses a method for producing a nubuck-like artificial leather in which, when an artificial leather substrate containing an elastic polymer inside an ultrafine fiber-entangled non-woven fabric is finished into a nubuck-like artificial leather, the method including the steps of: napping at least one surface of the substrate to form a napped surface; applying the elastic polymer to the napped surface; and further napping the surface to which the elastic polymer has been applied.

PTL 3 listed below discloses, as a napped artificial leather having both a good napping appearance and high pilling resistance, a napped artificial leather containing an elastic polymer inside a non-woven fabric structure formed by a fiber bundle of ultrafine filaments, and having a napped surface on a surface thereof, wherein an elastic polymer obtained from an aqueous dispersion of the elastic polymer is present at the base of the napped fibers and the vicinity thereof of the napped surface.

CITATION LIST

Patent Literatures

[PTL 1] Japanese Laid-Open Patent Publication No. 2003-268680

[PTL 2] Japanese Laid-Open Patent Publication No. 2007-262616

[PTL 3] Japanese Laid-Open Patent Publication No. 2011-074541

SUMMARY OF INVENTION

Technical Problem

It is an object of the present invention to provide a napped artificial leather having excellent whitening resistance against friction or abrasion of the napped surface.

Solution to Problem

An aspect of the present invention is directed to a napped artificial leather including a non-woven fabric including ultrafine fibers and a polyurethane, the napped artificial leather including a napped surface formed by napping the ultrafine fibers on a surface thereof, wherein the napped surface has, after a Martindale abrasion test in accordance with JIS L 1096 (6.17.5E method, Martindale method) under a pressing load of 12 kPa and 50000 times of abrasions, a ratio of the polyurethane observed by a surface observation using an electron microscope in a portion that has been subjected to the Martindale abrasion test, of 4.0% or less. With such a napped artificial leather, it is possible to obtain a napped artificial leather having high whitening resistance against friction or abrasion, such as a napped artificial leather that exhibits whitening represented by $\Delta L^* \leq 6.0$ after 50000 times of abrasions in a Martindale abrasion test, for example.

Preferably, the napped surface has a density of peaks (Spd) having a height of 100 μm or more from an average height, of 25/432 $mm^2$ or more, as measured in a surface roughness measurement in accordance with ISO 25178. With such a napped artificial leather, due to a large number of long fibers present on the napped surface, the polyurethane that has been formed into an agglomerate or a film is concealed by the long fibers on the napped surface, so that whitening is less likely to be exhibited.

Preferably, the ultrafine fibers have an average yarn toughness of 25.0 cN·% or less. When the yarn toughness is high, the ultrafine fibers are less likely to be cut by friction. Accordingly, for example, in a Martindale abrasion test, ultrafine fibers that are less likely to be cut due to the high yarn toughness and the polyurethane are rubbed in a state in which they coexist. As a result, the polyurethane is rubbed on the napped surface in a state in which the polyurethane is attached to the ultrafine fibers, so that the polyurethane attached to the ultrafine fibers is less likely to be detached and thus is formed into an agglomerate or a film, which tends to remain on the napped surface in that state. When the yarn toughness is low, the ultrafine fibers of the non-woven fabric that are present on the napped surface are likely to be cut to an appropriate degree. Therefore, even when the polyurethane is attached to the ultrafine fibers, the polyurethane is detached as a result of the ultrafine fibers being cut, and is removed to the outside of the system. Accordingly, the polyurethane is less likely to remain on the napped surface in a state in which the polyurethane is formed into an agglomerate or a film as a result of being rubbed for a long period of time, so that whitening is less likely to occur.

It is preferable that the ultrafine fibers contain 0.1 to 10 mass % of a pigment, because the average yarn toughness can be easily adjusted to 25.0 cN·% or less.

It is preferable that the napped surface has an L* value (lightness) based on an L*a*b* color system, of 35 or less, because the effects of the present invention become prominent.

It is preferable that a difference ΔL* in an L* value (lightness) based on an L*a*b* color system in a portion of the napped surface that has been subjected to the Martindale abrasion test before and after the Martindale abrasion test is 6.0 or less, from the viewpoint of achieving excellent resistance to whitening caused by friction or abrasion.

It is preferable that the polyurethane includes a first polyurethane impregnated into the non-woven fabric, and the first polyurethane has a content ratio of 15 mass % or less relative to a total amount of the non-woven fabric and the first polyurethane, because the amount of the polyurethane formed into an agglomerate or a film by friction is reduced. Preferably, the first polyurethane is an aqueous polyurethane.

It is preferable that the polyurethane further includes a second polyurethane unevenly distributed on the napped surface, and the second polyurethane has a 100% modulus of 4.5 to 12.5 MPa. In the case of applying a second polyurethane unevenly distributed on the napped surface, the napped surface tends to be whitened by abrasion. In such a case, when the second polyurethane has a 100% modulus of 4.5 to 12.5 MPa, the formation of the second polyurethane into an agglomerate or a film can be suppressed. When the second polyurethane is a solvent-based polyurethane solidified from a solution, the formation of the second polyurethane into an agglomerate or a film can be further suppressed.

Advantageous Effects of Invention

According to the present invention, it is possible to obtain a napped artificial leather having excellent whitening resistance against friction or abrasion.

DESCRIPTION OF EMBODIMENT

A napped artificial leather according to the present embodiment is a napped artificial leather including a non-woven fabric including ultrafine fibers and a polyurethane, the napped artificial leather including a napped surface formed by napping the ultrafine fibers on a surface thereof. Also, the napped surface has, after a Martindale abrasion test in accordance with JIS L 1096 (6.17.5E method, Martindale method) under a pressing load of 12 kPa and 50000 times of abrasions, a ratio of the polyurethane observed by a surface observation using an electron microscope in a portion that has been subjected to the Martindale abrasion test, of 4.0% or less.

The present inventor has studied in detail the cause of whitening of the napped surface of a napped artificial leather. Then, the inventor has noticed that the whitening is caused not only by the separation of ultrafine fibers, which has been known conventionally, but also as a result of the polyurethane contained in the napped artificial leather being elongated on the napped surface and formed into an agglomerate or a film by the napped surface of the napped artificial leather being rubbed, and the portion that has been formed into an agglomerate or a film makes the napped surface look whitish.

Figure 1:
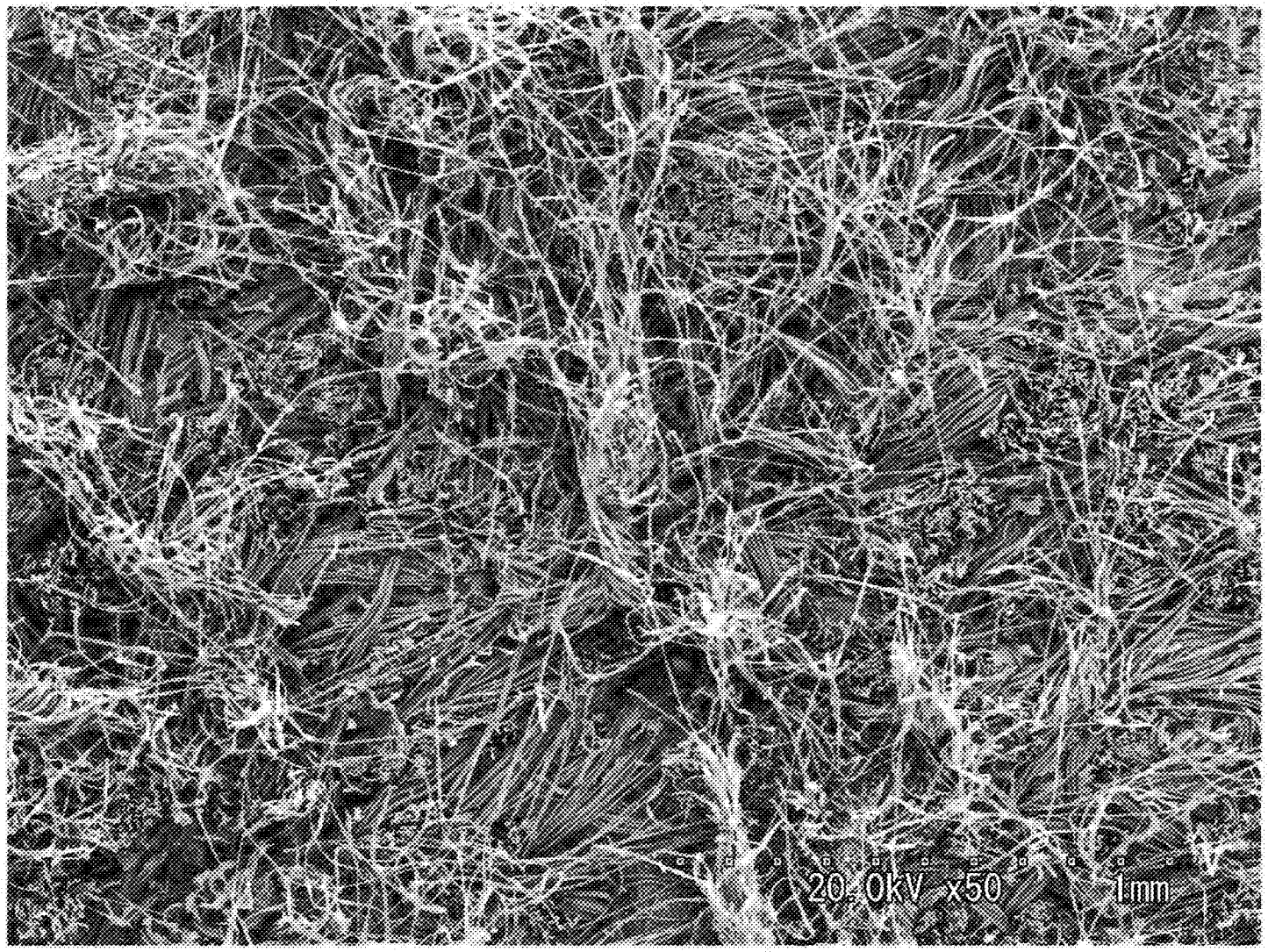
FIG. 1 is a scanning electron microscope (SEM) photograph after an abrasion test of a napped surface of a napped artificial leather obtained in Example 1.
Figure 2:
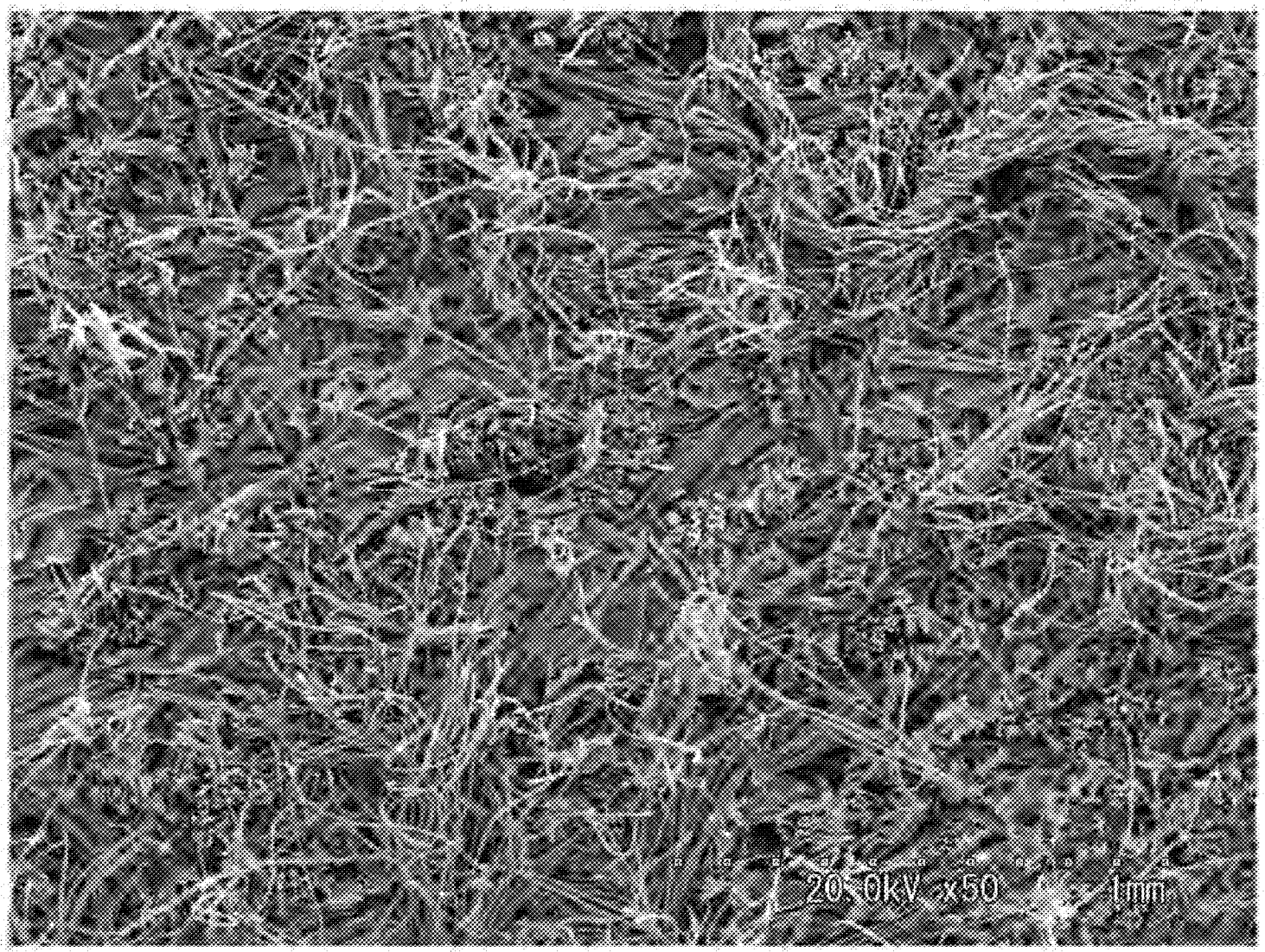
FIG. 2 is a SEM photograph after an abrasion test of a napped surface of a napped artificial leather obtained in Comparative Example 2.

FIG. 2 is a scanning electron microscope (SEM) photograph of a napped surface of a napped artificial leather obtained in Comparative Example 2, which will be described below, after a Martindale abrasion test in accordance with JIS L 1096 (6.17.5E method, Martindale method) under a pressing load of 12 kPa and 50000 times of abrasions. On the other hand, FIG. 1 is a scanning electron microscope (SEM) photograph of a napped surface of a napped artificial leather obtained in Example 1, which will be described below, after the Martindale abrasion test performed under the same conditions as described above. As will be described below, the area ratio of the polyurethane observed on the napped surface of the napped artificial leather obtained in the Comparative Example 2, as calculated from the SEM photograph in FIG. 2, is 9.62%, and the area ratio of the polyurethane observed on the napped surface of the napped artificial leather obtained in Example 1, as calculated from the SEM photograph in FIG. 1, is 0.98%.

By referring to FIGS. 1 and 2, it can be seen that the napped surface of the napped artificial leather obtained in Comparative Example 2, in which the change of the lightness L after the Martindale abrasion test was large, had a higher area ratio of the polyurethane than that of the napped surface of the napped artificial leather obtained in Example 1, in which the change of the lightness L* was small, as will be described below. Based on such findings, the present inventor has noticed that, since a polyurethane cannot be easily dyed and is whitish, the higher the ratio of the polyurethane observed on the napped surface, the more conspicuous the whitening caused by friction or abrasion becomes. Then, the inventor has arrived at the present invention by finding that the whitening of a napped artificial leather having an area ratio of the polyurethane observed on the napped surface after 50000 times of abrasions in a Martindale abrasion test, of 4.0% or less can be suppressed such that the lightness difference before and after the abrasion test satisfies ΔL*≤6.0, for example.

In the following, an embodiment of the napped artificial leather will be described in detail.

A napped artificial leather of the present embodiment includes a non-woven fabric including ultrafine fibers and a polyurethane, the napped artificial leather including a napped surface formed by napping the ultrafine fibers on a surface thereof.

The non-woven fabric including ultrafine fibers can be obtained, for example, by subjecting ultrafine fiber-generating fibers such as island-in-the-sea (matrix-domain) composite fibers to entangling treatment, and then to ultrafine fiber-generating treatment. Although the present embodiment describes in detail a case where the island-in-the-sea composite fibers are used, it is also possible to use ultrafine fiber-generating fibers other than the island-in-the-sea composite fibers. Alternatively, it is also possible to directly spin ultrafine fibers without using ultrafine fiber-generating fibers.

Examples of the production method of the non-woven fabric of ultrafine fibers include a method in which island-in-the-sea composite fibers are melt spun to produce a web, and the web is subjected to entangling treatment, and thereafter the sea component is selectively removed from the island-in-the-sea composite fibers, to form ultrafine fibers. In any of the processes until the sea component of the island-in-the-sea composite fibers is removed to form ultrafine fibers, fiber shrinking treatment such as heat shrinking treatment using water vapor may be performed to densify the island-in-the-sea composite fibers, thus making it possible to enhance the fullness.

Examples of the production method of the web include a method in which filaments of the island-in-the-sea composite fibers that have been spun by spunbonding or the like are collected on a net, without being cut, to form a filament web, and a method in which filaments are cut into staples to form a staple web. Among these, a filament web is particularly preferable because of excellent denseness and excellent fullness. The formed web may be subjected to fusion bonding treatment in order to impart shape stability thereto. Examples of the entangling treatment include a method in which about 5 to 100 layers of the web are placed on top of each other, and subjected to needle punching or high-pressure water jetting treatment.

Note that a filament means a continuous fiber, rather than a staple that has been intentionally cut after being spun. More specifically, a filament means a fiber other than a staple that has been intentionally cut so as to have a fiber length of about 3 to 80 mm, for example. The fiber length of the island-in-the-sea composite fibers before being subjected to ultrafine fibers generation is preferably 100 mm or more, and may have a fiber length of several meters, several hundred meters, several kilometers, or more, as long as the fibers are technically producible and are not inevitably cut during the production process. Note that some of filaments may be inevitably cut into staples during the production process by needle punching during entanglement or surface buffing.

The type of the ultrafine fibers included in the non-woven fabric is not particularly limited. Specific examples thereof include fibers of aromatic polyesters such as polyethylene terephthalate (PET), modified PETs such as isophthalic acid-modified PET, sulfoisophthalic acid-modified PET and cationic dye-dyeable modified PET, polybutylene terephthalate, and polyhexamethylene terephthalate; aliphatic polyesters such as polylactic acid, polyethylene succinate, polybutylene succinate, polybutylene succinate adipate, and a polyhydroxybutyrate-polyhydroxyvalerate resin; nylons such as nylon 6, nylon 66, nylon 10, nylon 11, nylon 12, and nylon 6-12; and polyolefins such as polypropylene, polyethylene, polybutene, polymethylpentene, and a chlorine-based polyolefin. Note that a modified PET is a PET obtained by substituting at least a portion of an ester-forming dicarboxylic acid-based monomer unit or a diol-based monomer unit of an unmodified PET with a monomer unit capable of substituting these units. Specific examples of the modified monomer unit capable of substituting the dicarboxylic acid-based monomer unit include units derived from an isophthalic acid, a sodium sulfoisophthalic acid, a sodium sulfonaphthalene dicarboxylic acid, and an adipic acid that are capable of substituting a terephthalic acid unit. Specific examples of the modified monomer unit capable of substituting a diol-based monomer unit include units derived from diols, such as a butane diol and a hexane diol, that are capable of substituting an ethylene glycol unit.

The average yarn toughness of the ultrafine fibers included in the non-woven fabric is preferably 25.0 cN·% or less. Here, the yarn toughness is a tensile toughness per fiber that can be calculated as described below, and is a property serving as an index indicating the tenacity and the level of rigidity per one fiber. The ultrafine fibers have an average yarn toughness of preferably 25.0 cN·% or less, more preferably 23.0 cN·% or less. When the average yarn toughness is 25.0 cN·% or less, the long ultrafine fibers on the napped surface are likely to be cut by friction, and the polyurethane is likely to be detached and removed to the outside of the system before the polyurethane is formed into an agglomerate or a film. The average yarn toughness is preferably 5 cN·% or more, more preferably 8 cN·% or more, from the viewpoint of achieving excellent abrasion resistance.

The ultrafine fibers may be colored by mixing a pigment such as carbon black and other additives therewith. For example, in the case of mixing a pigment such as carbon black into the ultrafine fibers, the content ratio of the pigment is not particularly limited, but is, for example, specifically, preferably 0.1 to 10 mass %, more preferably 0.5 to 7 mass %, because the ultrafine fibers are less likely to be brittle, and the yarn toughness will not be excessively reduced.

The average fineness of the ultrafine fibers is not particularly limited, but is preferably 0.05 to 0.7 dtex, more preferably 0.1 to 0.5 dtex. When the average fineness of the ultrafine fibers is too high, the yarn toughness is excessively increased, and the density of the ultrafine fibers on the napped surface is reduced, as a result of which the polyurethane becomes more visible, and whitening tends to be more conspicuous. When the average fineness of the ultrafine fibers is too low, the color development during dyeing tends to be reduced. Note that the average fineness is determined by imaging a cross section of the napped artificial leather that is parallel to the thickness direction thereof using a scanning electron microscope (SEM) at a magnification of 3000×, and calculating an average value of the diameters of evenly selected 15 fibers by using the densities of the resins that form the fibers.

The napped artificial leather includes a first polyurethane impregnated into the non-woven fabric. Specific examples of the first polyurethane include polyether urethane, polyester urethane, polyether ester urethane, polycarbonate urethane, polyether carbonate urethane, and polyester carbonate urethane. The first polyurethane may be a polyurethane (aqueous polyurethane) obtained by impregnating, into the non-woven fabric, an emulsion in which the polyurethane is dispersed in water, and thereafter solidifying the polyurethane by drying, or may be a polyurethane (solvent-based polyurethane) obtained by impregnating, into the non-woven fabric, a solution in which the polyurethane is dissolved in a solvent such as DMF, and thereafter solidifying the polyurethane by wet solidification. An aqueous polyurethane is particularly preferable.

It is preferable that the first polyurethane has a 100% modulus within the range of 4.5 to 12.5 MPa, from the viewpoint of suppressing the formation of the first polyurethane into an agglomerate or a film.

The content ratio of the first polyurethane impregnated into the non-woven fabric in the napped artificial leather is preferably 20 mass % or less, more preferably 15 mass % or less, and preferably 5 mass % or more, more preferably 10 mass % or more, relative to the total amount of the non-woven fabric and the first polyurethane. When the content ratio of the first polyurethane is too high, the first polyurethane is likely to be formed into an agglomerate or a film on the napped surface by friction or abrasion, and thus is likely to be whitened. When the content ratio of the first polyurethane is too low, the ultrafine fibers are pulled out from the napped surface by friction, and the quality of the appearance is likely to be reduced.

By buffing the surface of the non-woven fabric into which the first polyurethane has been impregnated, the ultrafine fibers on the surface layer are napped, and thereby a napped artificial leather is obtained. As for buffing, napping is performed by buffing the surface using sandpaper or emery paper with a grit number of preferably about 120 to 600, more preferably about 320 to 600. In this manner, a napped artificial leather having a napped surface on which napped ultrafine fibers are present on one side or both sides is obtained.

Here, it is preferable that a second polyurethane that fixes the vicinity of a base of the napped ultrafine fibers is applied to the napped surface of the napped artificial leather, in order to inhibit the napped ultrafine fibers from falling out and to make them difficult to be raised by friction, thus improving the quality of the appearance. Specifically, a solution or an emulsion containing the second polyurethane is applied to the napped surface, followed by drying, to solidify the second polyurethane. By fixing the second polyurethane to the vicinity of the base of the ultrafine fibers present on the napped surface, the vicinity of the base of the napped ultrafine fibers present on the napped surface is restrained by the second polyurethane, so that the ultrafine fibers are less likely to fall out, and also less likely to be raised by friction. As a result, an appearance with high quality is likely to be obtained.

Specific examples of the second polyurethane also include polyether urethane, polyester urethane, polyether ester urethane, polycarbonate urethane, polyether carbonate urethane, and polyester carbonate urethane. The second polyurethane may be a polyurethane (aqueous polyurethane) obtained by applying, to the napped surface, an emulsion in which the second polyurethane is dispersed, and thereafter solidifying the polyurethane by drying, or may be a polyurethane (solvent-based polyurethane) obtained by applying, to the napped surface, a solution in which the polyurethane is dissolved in a solvent such as DMF, and thereafter solidifying the polyurethane by drying. Among these, a solvent-based polyurethane is particularly preferable, because the solvent-based polyurethane is less likely to be formed into an agglomerate or a film by friction or abrasion.

The amount of the second polyurethane applied to the napped surface is preferably 0.5 to 10 g/m$^2$, more preferably 2 to 8 g/m$^2$, because the vicinity of the base of the ultrafine fibers can be firmly fixed without making the napped surface too hard, thus making it possible to decrease the length of freely movable ultrafine fibers.

It is preferable that the second polyurethane has a 100% modulus within the range of 4.5 to 12.5 MPa, because the second polyurethane is less likely to be formed into an agglomerate or a film. When the second polyurethane is a solvent-based polyurethane solidified from a solution, the formation of the second polyurethane into an agglomerate or a film by friction is further less likely to occur.

The napped artificial leather may be further subjected to a shrinkage processing treatment or a flexibilizing treatment by crumpling to adjust the texture, or a finishing treatment such as a reverse seal brushing treatment, an antifouling treatment, a hydrophilization treatment, a lubricant treatment, a softener treatment, an antioxidant treatment, an ultraviolet absorber treatment, a fluorescent agent treatment, and a flame retardant treatment.

The napped artificial leather is dyed, and thus is finished into a dyed napped artificial leather. As the dye, a suitable dye is selected as appropriate according to the type of the fibers. For example, when the ultrafine fibers are made from a polyester-based resin, it is preferable that the artificial leather substrate is dyed with a disperse dye or a cation dye. Specific examples of the disperse dye include benzene azo-based dyes (e.g., monoazo and disazo), heterocyclic azo-based dyes (e.g., thiazole azo, benzothiazole azo, quinoline azo, pyridine azo, imidazole azo, and thiophene azo), anthraquinone-based dyes, and condensate-based dyes (e.g., quinophthalone, styryl, and coumarin). These are commercially available as dyes with the prefix "Disperse", for example. These may be used alone or in a combination of two or more. As the dyeing method, it is possible to use a high-pressure jet dyeing method, a jigger dyeing method, a thermosol continuous dyeing machine method, a dyeing method using a sublimation printing process, and the like, without any particular limitation.

The napped artificial leather is colored with a pigment mixed in the ultrafine fibers, or by the above-described dyeing. It is preferable that the napped surface of the napped artificial leather has a dark color having an L value based on an L*a*b* color system, of 35 or less, more preferably 30 or less, because the effects of the present invention become more prominent. Also, it is preferable that a difference $\Delta L^*$ in an L* value (lightness) based on an L*a*b* color system in a portion of the napped surface that has been subjected to the Martindale abrasion test before and after the abrasion test is 6.0 or less, more preferably 5.0 or less, from the viewpoint of achieving excellent whitening resistance against friction or abrasion.

The apparent density of the napped artificial leather is preferably 0.4 to 0.7 g/cm$^3$, more preferably 0.45 to 0.6 g/cm$^3$, because a napped artificial leather that is well-balanced in fullness and a flexible texture that does not cause sharp bending can be obtained. When the apparent density of the napped artificial leather is too low, sharp bending tends to occur due to a low level of fullness. Further, the ultrafine fibers tend to be easily pulled out by rubbing the napped surface, resulting an appearance with low quality. On the other hand, when the apparent density of the napped artificial leather is too high, the flexible texture tends to be reduced.

As described above, the napped artificial leather of the present embodiment is a napped artificial leather including a non-woven fabric including ultrafine fibers and a polyurethane, the napped artificial leather including a napped surface formed by napping the ultrafine fibers on a surface thereof. Also, the napped surface has, after a Martindale abrasion test in accordance with JIS L 1096 (6.17.5E method, Martindale method) under a pressing load of 12 kPa and 50000 times of abrasions, a ratio of the polyurethane observed by a surface observation using an electron microscope, of 4.0% or less. When the area ratio of the polyurethane observed in the portion that has been subjected to the Martindale abrasion test on the napped surface after the abrasion test is 4.0% or less, the whitening of the napped surface caused by friction or abrasion is suppressed. The area ratio of the polyurethane is 4.0% or less, but is preferably 3.8% or less, more preferably 3% or less, because the whitening can be further suppressed.

It is preferable that, in the napped artificial leather of the present embodiment, the napped surface has a density of peaks (Spd) having a height of 100 m or more from an average height, of 25/432 $mm^2$ or more, more preferably 30/432 $mm^2$ or more, particularly preferably 35/432 $mm^2$ or more, as measured in a surface roughness measurement in accordance with ISO 25178. Such a surface state can be formed by adjusting the fineness of the ultrafine fibers, the yarn toughness of the ultrafine fibers, the density of the ultrafine fibers, and the production conditions such as the buffing conditions, as described above. With such a napped artificial leather, due to a large number of napped long ultrafine fibers present on the napped surface, even if the polyurethane is formed into a film, the polyurethane is concealed by the napped long ultrafine fibers on the napped surface, and thereby the whitening after abrasion is suppressed. When the density of peaks (Spd) is too low, the polyurethane that has been formed into a film is significantly exposed on the napped surface, so that whitening tends to be conspicuous. Note that "a density of peaks (Spd) of 25/432 $mm^2$ or more" means that the number of peaks having a height of 100 μm or more that are present per 432 $mm^2$ corresponds to 25 or more.

Here, ISO 25178 (surface roughness measurement) prescribes a method for three-dimensionally measuring a surface state by using a contact or non-contact surface roughness/shape measuring machine, the arithmetic mean height (Sa) represents the mean of absolute values of the height differences of various points with respect to the mean plane of the surface, and a density of peaks (Spd) having a height of 100 μm or more from the mean height indicates the number of peaks having a height of 100 μm or more from the mean height, out of the number of peaks per unit area (432 $mm^2$). Note that the measurement of the napped surface is performed by ordering the napped fibers in a grain direction in which the napped fibers are laid down when the napped surface is ordered with a seal brush.

EXAMPLES

Hereinafter, the present invention will be described more specifically by way of examples. It should be appreciated that the scope of the present invention is by no means limited by the examples.

First, the evaluation methods used in the present examples will be collectively described below.

[Area Ratio of Polyurethane (PU) Observed on Napped Surface after Abrasion Test]

A napped surface of a napped artificial leather was subjected to an abrasion test in accordance with JIS L 1096 (6.17.5E method, Martindale method) under a pressing load of 12 kPa and 50000 times of abrasions, using a Martindale abrasion tester. Then, a photograph of the napped surface after the abrasion test in a portion that had been subjected to the Martindale abrasion test was taken using a SEM at a magnification of 50×. FIG. 1 shows a SEM photograph of the napped surface of a napped artificial leather obtained in Example 1, and FIG. 2 shows a SEM photograph of the napped surface of a napped artificial leather obtained in Comparative Example 2. Then, the photograph was enlarged into A4 size, then was printed out, and the portion where the polyurethane appeared was colored in red. Then, the portion colored in red was cut out. Then, the overall weight of the entire observed region and the weight of the observed region after the cutting out were measured, and the area ratio of the portion where the polyurethane appeared was calculated. Note that the measurement was performed on three images of average portions, and an average value of the three images was determined.

[Evaluation of L* Value and ΔL* of Napped Surface Before and After Abrasion Test]

The L* value of the napped surface of the napped artificial leather based on an L*a*b* color system was measured using a spectrophotometer (U-3010, manufactured by Hitachi, Ltd.). First, the L* value of a napped surface of a napped artificial leather was measured. Then, the napped surface of the napped artificial leather was subjected to an abrasion test in accordance with JIS L 1096 (6.17.5E method, Martindale method) under a pressing load of 12 kPa and 50000 times of abrasions, using a Martindale abrasion tester. Then, the L value of the napped surface after the abrasion test was measured. Then, a lightness difference ΔL, which was the difference between the L value of the napped surface before the abrasion test and the L value of the napped surface after the abrasion test in a portion that had been subjected to the Martindale abrasion test, was calculated.

[Measurement of Surface State of Napped Surface]

The surface state of the napped surface of the napped artificial leather was measured in accordance with ISO 25178 (surface roughness measurement), using "One-Shot 3D Measuring Macroscope VR-3200" (manufactured by KEYENCE CORPORATION), which was a non-contact surface roughness/shape tester. Specifically, the fibers on the napped surface of the napped artificial leather were ordered with a seal brush in a grain direction in which the napped fibers were laid down. Then, for the range of 18 mm×24 mm of the napped surface with the ordered fibers, distorted fringe images were captured using a 4 mega-pixel monochrome C-MOS camera at a magnification of 12× under structured illumination light emitted from a high-intensity LED, and the density of peaks (Spd) having a height of 100 μm or more from the mean height was determined. The measurement was carried out three times, and the average values thereof were used as the numerical values.

[Yarn Toughness Measurement]

A plurality of island-in-the-sea composite fibers that had been spun in order to produce non-woven fabrics in the examples were attached with cellophane adhesive tape to the surface of a polyester film in a state in which the fibers were slightly loosened. Then, the sea component was removed by extraction by immersing the island-in-the-sea composite fibers in hot water at 95° C. for 30 minutes or more, thereby obtaining ultrafine fibers. Next, the polyester film to which the ultrafine fibers had been fixed was dyed using a Pot dyeing machine at 120° C. for 20 minuets, to obtain dyed yarns. Then, the strength and elongation were measured with an autograph while a bundle of the ultrafine fibers corresponding to a single island-in-the-sea composite fiber from among the dyed yarns were bound, and the strength and elongation of the fiber bundle of the ultrafine fibers were measured with the autograph. Then, the breaking strength and the breaking elongation were read from the peak top of the obtained SS curve, and the yarn toughness was calculated from the equation: Dyed yarn toughness (cN·%) =Breaking strength (cN)×Breaking elongation (%)/Number of ultrafine fibers.

[100% Modulus Measurement of Polyurethane]

A film of the first polyurethane or the second polyurethane used in the examples was formed, and the strength and elongation of a piece of the film that had been cut out to have a width of 2.5 cm were measured using an autograph. The strength of the obtained SS curve at an elongation of 100% was read, and the 100% modulus was calculated by dividing the read value by the cross-sectional area obtained based on the film thickness and a width of 2.5 cm.

Example 1

A water-soluble polyvinyl alcohol resin (PVA: sea component) and an isophthalic acid-modified polyethylene terephthalate (island component) that had a degree of modification of 6 mol % and to which 1.5 mass % of carbon black had been added were discharged from a multicomponent fiber melt-spinning spinneret (number of island: 12/fiber) at 260° C. at a throughput per hole of 1.5 g/min such that the sea component/the island component was 25/75 (mass ratio). The ejector pressure was adjusted such that the spinning rate was 3700 m/min, and filaments having an average fineness of 3.0 dtex were collected on a net, to obtain a fiber web.

Sixteen layers of the obtained fiber web were stacked by cross wrapping so as to have a total basis weight of 623 g/m$^2$, to obtain a superposed body, and an oil agent for preventing the needle from breaking was sprayed thereto. Next, the superposed body was needle-punched using 1-barb 42-gauge needles and 6-barb 42-gauge needles at 4189 punch/cm$^2$, to achieve entanglement, and thereby to obtain a web entangled sheet. The web entangled sheet had a basis weight of 745 g/m$^2$ and a delamination strength of 8.8 kg/2.5 cm. The area shrinkage due to the needle punching was 16.4%.

Next, the web entangled sheet was subjected to a steam treatment under the conditions of 110° C. and 23.5% RH. Then, the web entangled sheet was dried in an oven at 90 to 110° C., and thereafter further hot-pressed at 115° C., thereby obtaining a heat-shrunk web entangled sheet having a basis weight of 1310 g/m$^2$, a specific gravity of 0.641 g/cm$^3$, and a thickness of 2.13 mm.

Next, the heat-shrunk web entangled sheet was impregnated with an emulsion (solid content 16.5%) of a first polyurethane at a pick up of 50%. Note that the first polyurethane was a polycarbonate-based non-yellowing polyurethane. To the emulsion were added 4.9 parts by mass of a carbodiimide-based crosslinking agent and 6.4 parts by mass of ammonium sulfate per 100 parts by mass of the polyurethane and the emulsion was adjusted the solid content of the polyurethane to 10 mass %. The polyurethane forms a cross-linked structure by being heat-treated. Then, the heat-shrunk web entangled sheet that had been impregnated with the emulsion was dried under an atmosphere of 115° C. and 25% RH, and further dried at 150° C. Next, the web entangled sheet filled with the first polyurethane was immersed in hot water at 95° C. for 10 minutes while being subjected to nipping and high-pressure water jetting, to remove the PVA by dissolution, and was further dried, to obtain a fiber base material, which was a composite of a non-woven fabric including ultrafine fibers of filaments having a fineness of 0.30 dtex and the first polyurethane. The fiber base material had a basis weight of 1053 g/m$^2$, a specific gravity of 0.536 g/cm$^3$, and a thickness of 1.96 mm.

Next, the fiber base material was sliced in half, and thereafter both sides of the sliced fiber base material were ground under the conditions of a speed of 3.0 m/min and a rotation rate of 650 rpm, using a paper with a grid number of 120 for the back surface, and papers with grid numbers of 240, 320, and 600 for the front surface, to nap the fibers on the surface layer, thus forming a napped surface. Then, as a second polyurethane, a solution containing a polycarbonate-based polyurethane having a 100% modulus of 4.5 MPa, which was a solvent-based polyurethane, was applied to the napped surface, and the solution was dried, to apply 2 g/m$^2$ of the polyurethane as a solid content, thereby obtaining a suede-like artificial leather, which was a napped artificial leather. Then, using a disperse dye, the suede-like artificial leather was dyed by high-pressure dyeing at 120° C. In this manner, a black suede-like artificial leather was obtained. The black suede-like artificial leather had a basis weight of 371 g/m$^2$, an apparent density of 0.470 g/cm$^3$, and a thickness of 0.79 am. The content ratio of the first polyurethane in the black suede-like artificial leather was 10 mass %. Then, the black suede-like artificial leather was evaluated according to the above-described evaluation methods. The results are shown in Table 1.

TABLE 1

| | | Example No. | | | | | | | | |
|---|---|---|---|---|---|---|---|---|---|---|
| | | Example 1 | Example 2 | Example 3 | Example 4 | Example 5 | Com Ex. 1 | Com Ex. 2 | Com Ex. 3 | Com Ex. 4 |
| Ultrafine fibers | Fineness (dtex) | 0.3 | 0.3 | 0.3 | 0.3 | 0.3 | 0.33 | 0.3 | 0.3 | 0.3 |
| | Carbon black (%) | 1.5 | 1.0 | 1.0 | 0 | 1.5 | 0 | 1.0 | 1.0 | 0 |
| | Yarn toughness (cN · dtex) | 18.0 | 20.0 | 20.0 | 22.9 | 18.0 | 25.4 | 20.0 | 20.0 | 22.9 |
| First polyurethane | Form | Emulsion | Emulsion | Emulsion | Emulsion | Emulsion | Emulsion | Emulsion | Emulsion | Emulsion |
| | Ratio | 10 | 13 | 13 | 10 | 10 | 10 | 13 | 13 | 20 |
| | 100% modulus (MPa) | 5.0 | 5.0 | 5.0 | 5.0 | 5.0 | 5.0 | 5.0 | 5.0 | 5.0 |
| Second polyurethane | Form | Solution | Solution | Solution | Solution | Emulsion | Solution | Solution | Solution | |
| | 100% modulus (MPa) | 4.5 | 4.5 | 12.5 | 4.5 | 5.0 | 4.5 | 16 | 3.25 | |
| Color | | Black | Black | Black | Brown | Black | Brown | Black | Black | Pink |
| Spd (/432 mm$^2$) | | 114 | 49 | 41 | 35 | 323 | 191 | 9 | 22 | 13.7 |
| Surface Pu ratio after abrasion test | (%) | 0.98 | 3.42 | 1.54 | 0.30 | 3.1 | 4.32 | 9.62 | 4.81 | 5.13 |

TABLE 1-continued

| | | Example No. | | | | | | | | |
|---|---|---|---|---|---|---|---|---|---|---|
| | | Example 1 | Example 2 | Example 3 | Example 4 | Example 5 | Com Ex. 1 | Com Ex. 2 | Com Ex. 3 | Com Ex. 4 |
| L* value | Before abrasion test | 17.35 | 18.96 | 19.04 | 29.35 | 16.78 | 28.72 | 18.83 | 18.24 | 43.51 |
| | After abrasion test | 19.78 | 22.49 | 23.81 | 32.57 | 22.1 | 34.95 | 27.2 | 26.04 | 55.77 |
| | ΔL* | 2.43 | 3.53 | 4.77 | 3.22 | 5.32 | 6.23 | 8.37 | 7.80 | 12.26 |

Example 2

A black suede-like artificial leather was obtained and evaluated in the same manner as in Example 1 except that the mixing ratio of carbon black in the island component for forming ultrafine fibers was changed from 1.5 mass % to 1.0 mass %, and that the content ratio of the first polyurethane was changed from 10 mass % to 13 mass %. The results are shown in Table 1.

Example 3

A black suede-like artificial leather was obtained and evaluated in the same manner as in Example 1 except that the mixing ratio of carbon black in the island component for forming ultrafine fibers was changed from 1.5 mass % to 1.0 mass %, that the content ratio of the first polyurethane was changed from 10 mass % to 13 mass %, and that a solution of a solvent-based polyurethane having a 100% modulus of 12.5 MP, which was a solvent-based polyurethane, was applied as the second polyurethane, instead of applying the solution of a polycarbonate-based polyurethane resin having a 100% modulus of 4.5 MPa, which was a solvent-based polyurethane. The results are shown in Table 1.

Example 4

A brown suede-like artificial leather was obtained and evaluated in the same manner as in Example 1 except that carbon black was not mixed, instead of mixing 1.5 mass % of carbon black in the island component for forming ultrafine fibers. The results are shown in Table 1.

Example 5

A black suede-like artificial leather was obtained and evaluated in the same manner as in Example 1 except that a water-dispersed emulsion having a 100% modulus of 5.0 MPa was applied as the second polyurethane. The results are shown in Table 1.

Comparative Example 1

A brown suede-like artificial leather was obtained and evaluated in the same manner as in Example 1 except that the non-woven fabric of ultrafine fibers with 0.30 dtex was changed to a non-woven fabric of ultrafine fibers with 0.33 dtex, and that carbon black was not mixed, instead of mixing 1.5 mass % of carbon black in the island component for forming ultrafine fibers. The results are shown in Table 1.

Comparative Example 2

A black suede-like artificial leather was obtained and evaluated in the same manner as in Example 1 except that the mixing ratio of carbon black in the island component for forming ultrafine fibers was changed from 1.5 mass % to 1.0 mass %, that the ratio of the polyurethane impregnated into the non-woven fabric in the fiber base material was changed from 10 mass % to 13 mass %, and that a polyurethane having a 100% modulus of 16 MPa was applied to the surface, instead of applying the polycarbonate-based polyurethane resin having a 100% modulus of 4.5 MPa. The results are shown in Table 1.

Comparative Example 3

A black suede-like artificial leather was obtained and evaluated in the same manner as in Example 1 except that the mixing ratio of carbon black in the island component for forming ultrafine fibers was changed from 1.5 mass % to 1.0 mass %, that the content ratio of the first polyurethane was changed from 10 mass % to 13 mass %, and that a polyurethane having a 100% modulus of 3.25 MPa, which was a solvent-based polyurethane, was applied as the second polyurethane, instead of applying the solution of the polycarbonate-based polyurethane resin having a 100% modulus of 4.5 MPa, which was a solvent-based polyurethane. The results are shown in Table 1.

Comparative Example 4

A pink suede-like artificial leather was obtained and evaluated in the same manner as in Example 1 except that carbon black was not mixed, instead of mixing 1.5 mass % of carbon black in the island component for forming ultrafine fibers, that the content ratio of the first polyurethane was changed from 10 mass % to 20 mass %, and that the second polyurethane was not applied. The results are shown in Table 1.

By referring to Table 1, it can be seen that all of the suede-like artificial leathers of Comparative Examples 1 to 4, in which the area ratio of the polyurethane observed by the surface observation after the abrasion test using a SEM exceeded 4.0%, had a ΔL* exceeding 6.0, whereas all of the suede-like artificial leathers of Examples 1 to 5, in which the area ratio of the polyurethane was 4.0% or less, had a ΔL* of 6.0 or less, indicating excellent resistance to whitening caused by friction and abrasion. The comparison of Examples 1 and 5 shows that Example 1, in which the solvent-based polyurethane was applied as the second polyurethane, had a lower area ratio of the polyurethane than that of Example 5, in which the emulsion-based polyurethane was applied. The comparison of Examples 2 and 3, and Comparative Example 2 shows that when the 100% modulus of the second polyurethane was too high as in the case of Comparative Example 2, the area ratio of the polyurethane was excessively increased, resulting in an increase of Δ*L.

INDUSTRIAL APPLICABILITY

A napped artificial leather obtained according to the present invention can be preferably used as a skin material for clothing, shoes, articles of furniture, car seats, general merchandise, and the like.

The invention claimed is:

1. A napped artificial leather, comprising:

a non-woven fabric comprising ultrafine fibers and a polyurethane, the napped artificial leather comprising a napped surface formed by napping the ultrafine fibers on a surface thereof, wherein the ultrafine fibers have an average fineness of 0.1 to 0.5 dtex and an average yarn toughness of 20.0 cN·% or less, and contain 1.0 to 1.5 mass % of carbon black, the polyurethane comprises a first polyurethane impregnated into the non-woven fabric and a second polyurethane fixed to a base of the napped ultrafine fibers on the napped surface, where the first polyurethane is an aqueous polyurethane and the second polyurethane is a solvent-based polyurethane having a 100% modulus of 4.5 to 12.5 MPa, an amount of the first polyurethane is from 5 mass % to 15 mass % relative to a total amount of the non-woven fabric and the first polyurethane, the napped surface has a density of peaks (Spd) having a height of 100 μm or more greater than an average height, of 25/432 $mm^2$ or more, as measured in a surface roughness measurement in accordance with ISO 25178, the napped surface has an L* value (lightness) based on an L*a*b* color system, of 19.04 or less, and when the napped surface is subjected to a Martindale abrasion test in accordance with JIS L 1096 (6.17.5E method, Martindale method) under a pressing load of 12 kPa and 50000 times of abrasions, a ratio of an area where the polyurethane is observed by a surface observation using an electron microscope in a portion that has been subjected to the Martindale abrasion test is 4.0% or less with respect to an area of the portion that has been subjected to the Martindale abrasion test, and a difference ΔL* in an L* value (lightness) based on an L*a*b* color system in the portion that has been subjected to the Martindale abrasion test before and after the Martindale abrasion test is 3.53 or less.

2. The napped artificial leather according to claim 1, wherein the napped surface has the density of peaks (Spd) having a height of 100 μm or more greater than an average height, of 35/432 $mm^2$ or more, as measured in the surface roughness measurement in accordance with ISO 25178.

3. The napped artificial leather according to claim 1, wherein the ultrafine fibers have the average yarn toughness of from 8 cN·% to 20.0 cN·%.

4. The napped artificial leather according to claim 1, wherein the amount of the first polyurethane is from 10 mass % to 15 mass % relative to the total amount of the non-woven fabric and the first polyurethane.

5. The napped artificial leather according to claim 1, wherein the ultrafine fibers have the average yarn toughness of from 18.0 cN·% to 20.0 cN·%.

6. The napped artificial leather according to claim 1, wherein an amount of the second polyurethane is 2 to 8 $g/m^2$.

7. The napped artificial leather according to claim 1, wherein the ultrafine fibers have an average fineness of 0.3 to 0.5 dtex.

* * * * *